US010035524B2

(12) United States Patent
Nakao et al.

(10) Patent No.: US 10,035,524 B2
(45) Date of Patent: Jul. 31, 2018

(54) BOGIE FOR RAILCAR

(71) Applicant: KAWASAKI JUKOGYO KABUSHIKI KAISHA, Kobe-shi, Hyogo (JP)

(72) Inventors: Shunichi Nakao, Kobe (JP); Takeyoshi Kusunoki, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/537,555

(22) PCT Filed: Dec. 2, 2015

(86) PCT No.: PCT/JP2015/005994
§ 371 (c)(1),
(2) Date: Jun. 19, 2017

(87) PCT Pub. No.: WO2016/098299
PCT Pub. Date: Jun. 23, 2016

(65) Prior Publication Data

US 2017/0349189 A1 Dec. 7, 2017

(30) Foreign Application Priority Data

Dec. 17, 2014 (JP) ..... 2014-254687

(51) Int. Cl.
*B61F 5/32* (2006.01)
*B61F 3/02* (2006.01)
*B61F 5/52* (2006.01)

(52) U.S. Cl.
CPC ..... *B61F 5/32* (2013.01); *B61F 3/02* (2013.01); *B61F 5/52* (2013.01)

(58) Field of Classification Search
CPC ..... B61F 3/00; B61F 3/02; B61F 5/32; B61F 5/52
See application file for complete search history.

(56) References Cited

U.S. PATENT DOCUMENTS 3,806,148 A 4/1974 Boulton
5,039,071 A * 8/1991 Irle ..... B61F 5/148 105/197.05

(Continued)

FOREIGN PATENT DOCUMENTS

JP 2000-502974 A 3/2000
JP 2007-203952 A 8/2007

(Continued)

OTHER PUBLICATIONS

Mar. 1, 2016 International Search Report issued in International Patent Application No. PCT/JP2015/005994.

*Primary Examiner* — Jason C Smith
(74) *Attorney, Agent, or Firm* — Oliff PLC

(57) ABSTRACT

A bogie includes: a plate spring extending in a car longitudinal direction in a state where a first end portion of the plate spring is supported by the first axle box, and a second end portion of the plate spring is supported by the second axle box, the plate spring supporting the pressing member from below so as to be displaceable relative to the pressing member; a first upper link connected to the cross beam and the first axle box and including a first end portion elastically coupled to the first axle box; a first lower link connected to the cross beam and the first axle box and including a first end portion elastically coupled to the first axle box; a second upper link connected to the cross beam and the second axle box and including a first end portion elastically coupled to the second axle box; and a second lower link connected to the cross beam and the second axle box and including a first end portion elastically coupled to the second axle box, a coupling point where the first end portion of the first upper link and the first axle box are coupled to each other and a coupling point where the first end portion of the first lower link and the first axle box are coupled to each other being arranged on a first virtual straight line passing through a (Continued)

center of the first axle in a side view, a coupling point where the first end portion of the second upper link and the second axle box are coupled to each other and a coupling point where the first end portion of the second lower link and the second axle box are coupled to each other being arranged on a second virtual straight line passing through a center of the second axle in the side view.

15 Claims, 11 Drawing Sheets

(56) References Cited

U.S. PATENT DOCUMENTS 6,250,232 B1* 6/2001 Hachnnann ..... B61F 5/325 105/157.1
6,338,300 B1* 1/2002 Landrot ..... B61F 5/305 105/182.1
9,688,292 B2* 6/2017 Nishimura ..... B61F 3/04
2005/0116436 A1* 6/2005 Landrot ..... B61F 5/305 280/124.109
2014/0123870 A1* 5/2014 Nishimura ..... B61F 5/302 105/197.05
2014/0137765 A1* 5/2014 Nishimura ..... B61F 5/52 105/182.1
2015/0000553 A1* 1/2015 Kimura ..... B61F 5/30 105/197.05
2015/0020708 A1* 1/2015 Nishimura ..... B61F 3/02 105/197.05
2015/0047529 A1* 2/2015 Nishimura ..... B61F 5/32 105/199.3
2015/0083019 A1* 3/2015 Nishimura ..... B61F 5/32 105/197.05
2015/0158506 A1* 6/2015 Nishimura ..... B61F 5/52 105/197.05
2015/0344046 A1* 12/2015 Nishimura ..... B61F 5/52 105/199.1
2015/0344047 A1 12/2015 Nishimura et al.
2015/0353105 A1* 12/2015 Nishimura ..... B61F 5/52 105/199.1
2016/0251023 A1* 9/2016 Nishimura ..... B61F 5/302 105/198.6
2016/0304102 A1* 10/2016 Okumura ..... B61F 5/302
2016/0320229 A1* 11/2016 Nishimura ..... G01G 19/042
2017/0151963 A1* 6/2017 Sakahira ..... B61F 1/14
2017/0341663 A1* 11/2017 Nakao ..... B61F 3/08
2017/0349189 A1* 12/2017 Nakao ..... B61F 5/32

FOREIGN PATENT DOCUMENTS

JP 2010-42778 A 2/2010
JP 2010-274685 A 12/2010
JP 2011-148367 A 8/2011
JP 2012-126340 A 7/2012
JP 2013-216175 A 10/2013
JP 5442167 B2 3/2014
KR 2012-0064288 A 6/2012
WO WO2014/109280 A1 1/2017

* cited by examiner

BOGIE FOR RAILCAR

TECHNICAL FIELD

The present invention relates to a bogie supporting a carbody of a railcar.

BACKGROUND ART

In a railcar, a carbody is supported by a bogie. In recent years, railcars such as an LRV (Light Rail Vehicle) are spreading, and bogies for realizing a low floor of the railcar are desired. A bogie of PTL 1 realizes the low floor in such a manner that a bogie frame constituted by side sills and a cross beam is formed in a concave shape in a front view.

On the other hand, the bogies are also desired to secure ride quality and traveling safety. According to a bogie of PTL 2, a bearing is provided between a cross beam and each of a pair of side sills, and the side sills are supported by the cross beam so as to be rotatable about a rotation axis extending in a car width direction (sleeper direction). According to this, even if there is, for example, irregularity of the height of a track, the left and right side sills relatively rotate about the rotation axis of the bearing portion, so that followability of wheels with respect to the track improves, and force (wheel load) applied from the wheels to the track in a vertical direction stabilizes. Thus, derailment can be prevented.

CITATION LIST

Patent Literature

PTL 1: Japanese Laid-Open Patent Application Publication No. 2010-274685

PTL 2: Japanese Laid-Open Patent Application Publication No. 2011-148367

SUMMARY OF INVENTION

Technical Problem

According to PTL 2, since the left and right side sills can swing asymmetrically in the vertical direction, a decrease of wheel load is prevented. However, PTL 2 does not consider a reduction in force (lateral force) applied from the track to the wheels in the car width direction. If a ratio Q/P (derailment coefficient) of lateral force (Q) to wheel load (P) becomes a predetermined value or more, a possibility that flanges of the wheels get on the track and derailment occurs increases. Therefore, to effectively prevent the derailment, desired is a configuration which can prevent the decrease of wheel load and adequately reduce the lateral force.

Further, a bogie which realizes a weight reduction and the low floor while securing the traveling safety is desired. According to the bogie of PTL 1, the low floor is realized. However, the bogie frame has a complex configuration, and the weight reduction is not realized.

An object of the present invention is to provide a bogie which secures traveling safety while realizing a low floor and a weight reduction.

Solution to Problem

A bogie for a railcar according to one aspect of the present invention includes: a first axle box accommodating a first bearing supporting a first axle such that the first axle is rotatable; a second axle box accommodating a second bearing supporting a second axle such that the second axle is rotatable; a cross beam extending in a car width direction, a pressing member being provided on a lower side of the cross beam; a plate spring extending in a car longitudinal direction in a state where a first end portion of the plate spring is supported by the first axle box, and a second end portion of the plate spring is supported by the second axle box, the plate spring supporting the pressing member from below so as to be displaceable relative to the pressing member; a first upper link extending in the car longitudinal direction to connect the cross beam and the first axle box and including a first end portion elastically coupled to the first axle box; a first lower link extending in the car longitudinal direction to connect the cross beam and the first axle box and including a first end portion elastically coupled to the first axle box; a second upper link extending in the car longitudinal direction to connect the cross beam and the second axle box and including a first end portion elastically coupled to the second axle box; and a second lower link extending in the car longitudinal direction to connect the cross beam and the second axle box and including a first end portion elastically coupled to the second axle box, a first upper coupling point where the first end portion of the first upper link and the first axle box are coupled to each other and a first lower coupling point where the first end portion of the first lower link and the first axle box are coupled to each other being arranged on a first virtual straight line passing through a center of the first axle in a side view, a second upper coupling point where the first end portion of the second upper link and the second axle box are coupled to each other and a second lower coupling point where the first end portion of the second lower link and the second axle box are coupled to each other being arranged on a second virtual straight line passing through a center of the second axle in the side view.

According to the above configurations, the links serving as the coupling members connecting the cross beam and the axle boxes and the plate spring supporting the pressing member of the cross beam from below have simple configurations extending in the car longitudinal direction. Therefore, the low floor of the railcar can be easily realized by lowering the position of the cross beam, and the weight reduction can be realized. Further, the first upper link and the first lower link are elastically coupled to the first axle box, and the second upper link and the second lower link are elastically coupled to the second axle box. Therefore, the first and second axles can be angularly displaced relative to the cross beam in the steering direction. Then, the coupling point where the first end portion of the first upper link and the first axle box are coupled to each other and the coupling point where the first end portion of the first lower link and the first axle box are coupled to each other are arranged on the first virtual straight line passing through the center of the first axle in the side view, and the coupling point where the first end portion of the second upper link and the second axle box are coupled to each other and the coupling point where the first end portion of the second lower link and the second axle box are coupled to each other are arranged on the second virtual straight line passing through the center of the second axle in the side view. Therefore, even when the bogie travels in any direction along the car longitudinal direction (even when the bogie travels forward or backward), the axles are naturally and smoothly steered (turned) along a leftward/rightward direction curve of the track using the virtual straight lines as reference lines. On this account, the lateral force from the track can be reduced. Further, the plate spring supports the pressing member, provided at the cross beam, so as to be displaceable relative to the pressing member. The first axle box and the cross beam are connected to each other by a pair of upper and lower links, and the second axle box and the cross beam are connected to each other by a pair of upper and lower links. Therefore, twisting force is hardly transferred between the cross beam and the plate spring, and the axle boxes of the bogie can be independently and smoothly displaced in the vertical direction. On this account, the wheels easily follow, for example, ups and downs of the track. Thus, the decrease of wheel load can be effectively prevented.

Advantageous Effects of Invention

As is clear from the above explanation, the present invention can secure the traveling safety while realizing the low floor and the weight reduction.

DESCRIPTION OF EMBODIMENTS

Figure 1:
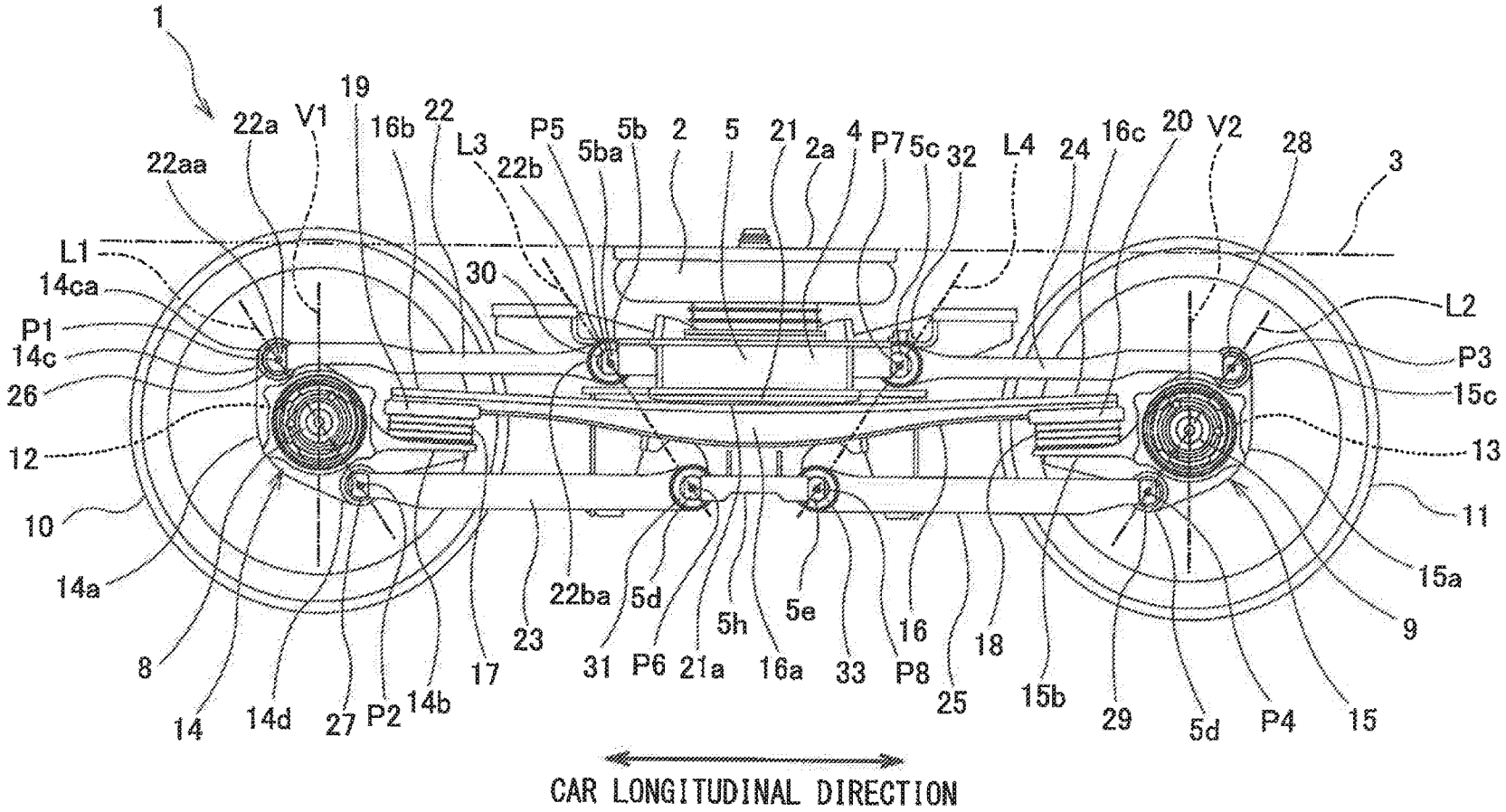
FIG. 1 is a side view showing a bogie for a railcar according to Embodiment 1.

Hereinafter, embodiments will be explained in reference to the drawings. In the following explanation, a direction in which a railcar travels, that is, a length direction in which a carbody extends is defined as a car longitudinal direction, and a crosswise direction orthogonal to the car longitudinal direction is defined as a car width direction (It should be noted that the car longitudinal direction may also be referred to as a forward/rearward direction, and the car width direction may also be referred to as a leftward/rightward direction.). Further, in the drawings, the same reference signs are used for the same components.

Embodiment 1

Figure 2:
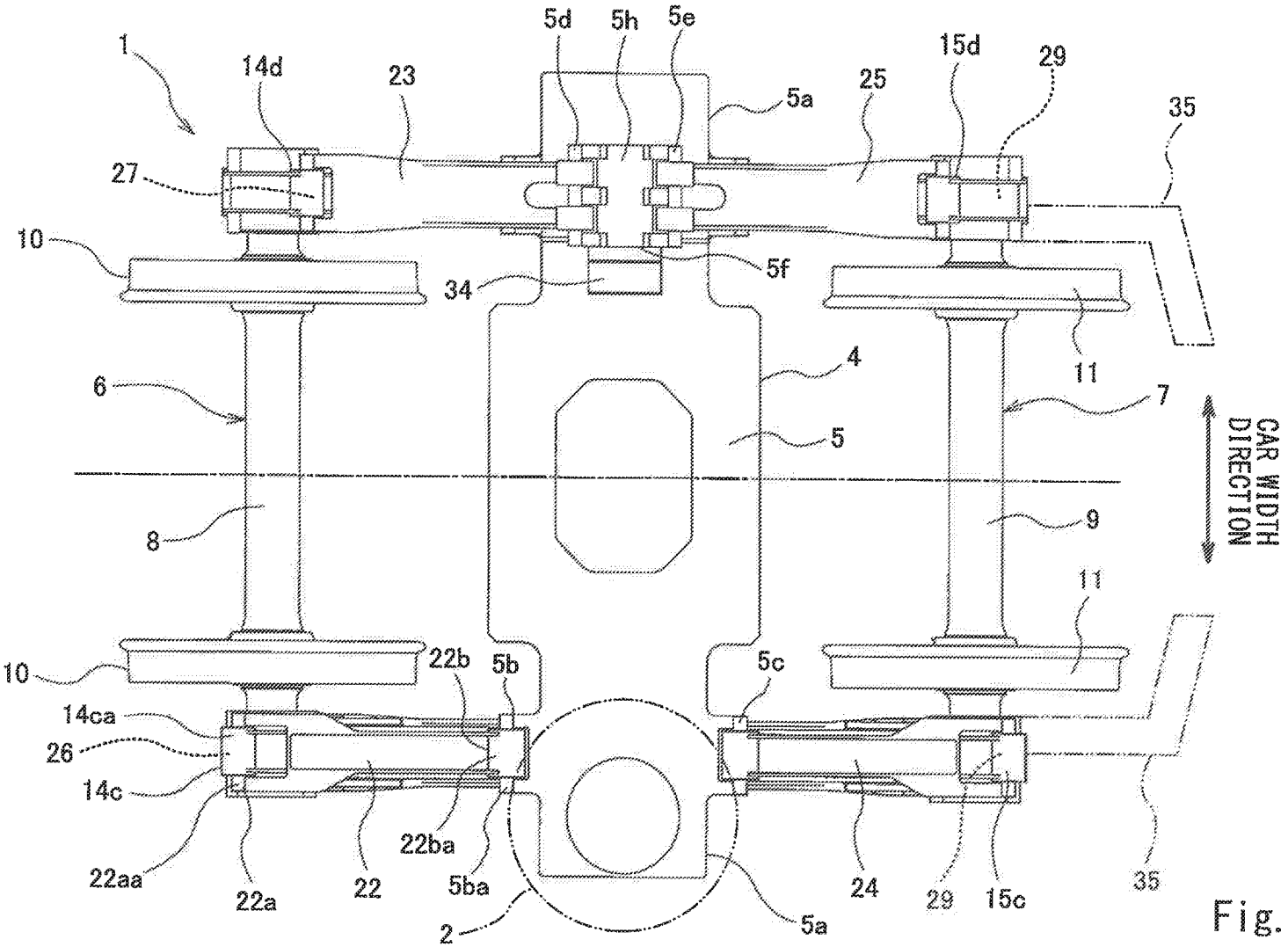
FIG. 2 is a plan view showing the bogie of FIG. 1. An upper half of FIG. 2 is a diagram when viewed from below, and a lower half of FIG. 2 is a diagram when viewed from above.
Figure 3:
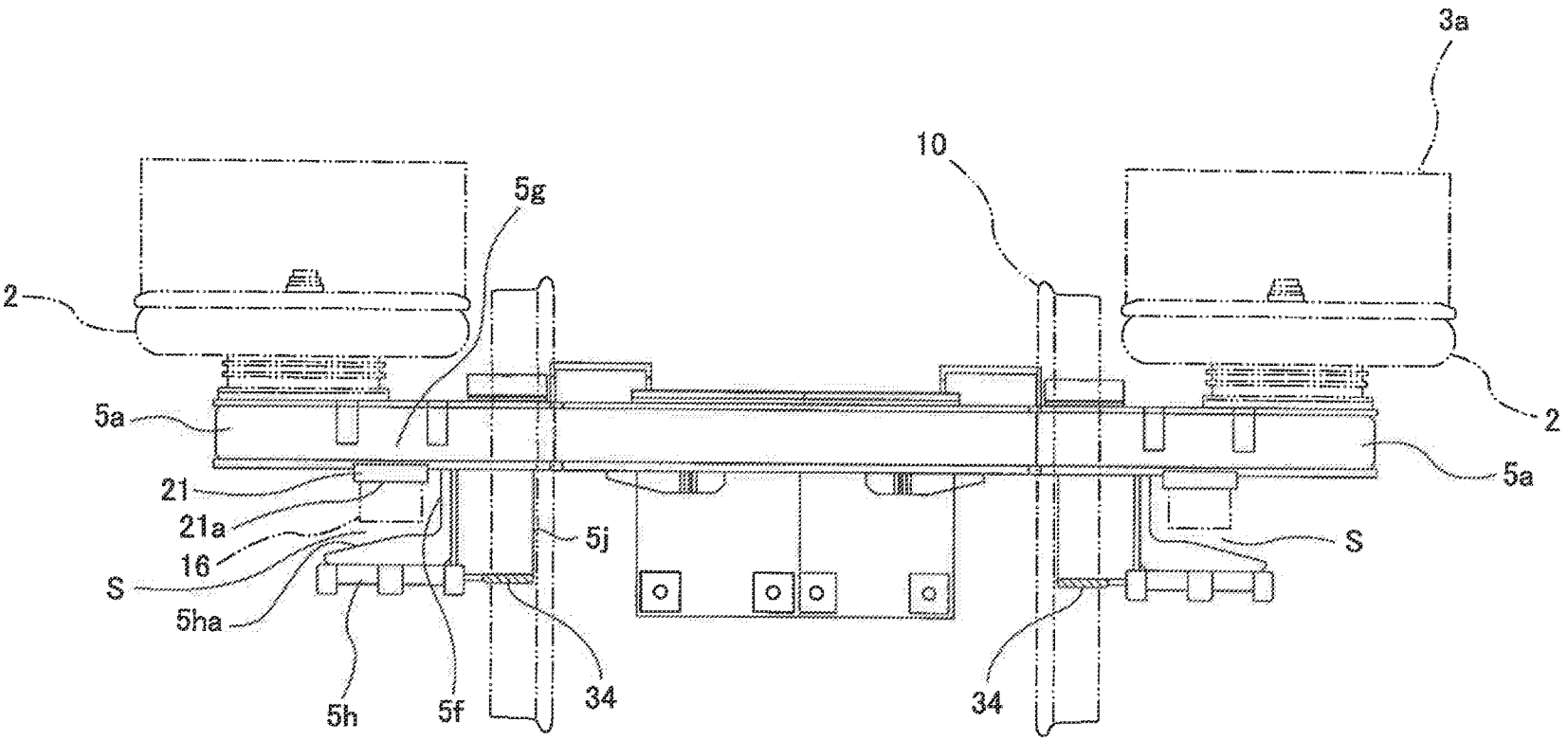
FIG. 3 is a diagram showing a cross beam of the bogie of FIG. 1 when viewed from a car longitudinal direction.

FIG. 1 is a side view showing a bogie 1 for a railcar according to Embodiment 1. FIG. 2 is a plan view showing the bogie 1 of FIG. 1. An upper half of FIG. 2 is a diagram when viewed from below, and a lower half of FIG. 2 is a diagram when viewed from above. FIG. 3 is a diagram showing a cross beam 5 of the bogie 1 of FIG. 1 when viewed from the car longitudinal direction. As shown in FIGS. 1 to 3, the bogie 1 for the railcar includes a bogie frame 4 supporting a carbody 3 through a pair of left and right air springs 2 serving as secondary suspensions. The bogie frame 4 includes the cross beam 5 extending in the car width direction and supporting the carbody. A first wheelset 6 is arranged in front of the cross beam 5, and a second wheelset 7 is arranged behind the cross beam 5. The first wheelset 6 includes: a first axle 8 extending in the car width direction; and first wheels 10 fixed to both respective sides of the first axle 8. The second wheelset 7 includes: a second axle 9 extending in the car width direction; and second wheels 11 fixed to both respective sides of the second axle 9.

First bearings 12 are provided at both respective car width direction end portions of the first axle 8 and support the first axle 8 such that the first axle 8 is rotatable. Second bearings 13 are provided at both respective car width direction end portions of the second axle 9 and support the second axle 9 such that the second axle 9 is rotatable. The first bearings 12 are accommodated in respective first axle boxes 14, and the second bearings 13 are accommodated in respective second axle boxes 15. Each of plate springs 16 extending in the car longitudinal direction is provided between the first axle box 14 and the second axle box 15. The plate spring 16 is formed by, for example, fiber-reinforced resin. Longitudinal direction middle portions 16*a* of the plate springs 16 support both respective car width direction end portions 5*a* of the cross beam 5 from below so as to be separable from the car width direction end portions 5*a*. A longitudinal direction first end portion 16*b* and a longitudinal direction second end portion 16*c* of the plate spring 16 are supported from below by the first axle box 14 and the second axle box 15, respectively. To be specific, the plate spring 16 achieves a function of a primary suspension and a part of a function of a conventional side sill.

The first axle box 14 includes: a first main body portion 14*a* accommodating the first bearing 12; and a first spring supporting portion 14*b* projecting from the first main body portion 14*a* toward a middle side in the car longitudinal direction and supporting the first end portion 16*b* of the plate spring 16 from below. The second axle box 15 includes: a second main body portion 15*a* accommodating the second bearing 13; and a second spring supporting portion 15*b* projecting from the second main body portion 15*a* toward the middle side in the car longitudinal direction and supporting the second end portion 16*c* of the plate spring 16 from below. The first end portion 16*b* of the plate spring 16 is supported by the first spring supporting portion 14*b* from below, and the second end portion 16*c* of the plate spring 16 is supported by the second spring supporting portion 15*b* from below. Specifically, a first multi-layer rubber 17 is provided on the first spring supporting portion 14*b*, and a second multi-layer rubber 18 is provided on the second spring supporting portion 15*b*. A first receiving seat 19 is provided on the first multi-layer rubber 17, and a second receiving seat 20 is provided on the second multi-layer rubber 18. The first end portion 16*b* of the plate spring 16 is provided on the first receiving seat 19, and the second end portion 16*c* of the plate spring 16 is provided on the second receiving seat 20.

Pressing members 21 each including a pressing surface 21*a* facing downward are provided at both respective car width direction end portions 5*a* of the cross beam 5. The pressing members 21 are separate members fixed to a main body of the cross beam but may be formed integrally with the main body of the cross beam. Each of the pressing surfaces 21*a* of the pressing members 21 has a circular-arc shape that is convex downward in a side view. The pressing member 21 is formed by a rigid member (for example, metal or fiber-reinforced resin). The pressing member 21 is placed on the middle portion 16*a* of the plate spring 16 from above so as to be displaceable relative to the plate spring 16. To be specific, the pressing surface 21*a* of the pressing member 21 presses an upper surface of the plate spring 16 by the load of the cross beam 5 in a state where the plate spring 16 is not fixed to the pressing member 21 in an upward/downward direction. It should be noted that the upper surface of the plate spring 16 may contact the pressing member 21 through rubber or the like. In a no-load state, the upper surface of the plate spring 16 is a horizontal flat surface. The longitudinal direction middle portion 16*a* of the plate spring 16 is thicker in the upward/downward direction than each of the longitudinal direction first end portion 16*b* and longitudinal direction second end portion 16*c* of the plate spring 16. As one example, a lower surface of the plate spring 16 includes a circular-arc surface that is convex downward. It should be noted that FIG. 1 shows the bogie 1 supporting the carbody 3 in an empty car state. In the empty car state, the plate spring 16 elastically deforms such that the shape of an upper surface of the middle portion 16*a* becomes a circular-arc shape corresponding to the shape of a lower surface of the pressing member 21 (When the bogie 1 supports the carbody 3 in a full car state, the plate spring 16 elastically deforms further).

As above, the plate spring 16 is not fixed to the pressing member 21 and the receiving seats 19 and 20 by bolts or the like. Therefore, even when a height difference is generated between the front and rear wheels 10 and 11, the plate spring 16 rotates with respect to the pressing surface 21*a* of the pressing member 21 so as to follow vertical displacements of the wheels 10 and 11, and the input of a load from the plate spring 16 to the front axle box 14 and the input of a load from the plate spring 16 to the rear axle box 15 tend to be equalized. Thus, a decrease of wheel load can be prevented.

The cross beam 5 and the first axle box 14 are coupled to each other by a pair of a first upper link 22 and a first lower link 23 so as to be turnable, the first upper link 22 and the first lower link 23 extending in the car longitudinal direction. The cross beam 5 and the second axle box 15 are coupled to each other by a pair of a second upper link 24 and a second lower link 25 so as to be turnable, the second upper link 24 and the second lower link 25 extending in the car longitudinal direction. A set of the first upper link 22 and the first lower link 23 constitutes a parallel link, and a set of the second upper link 24 and the second lower link 25 constitutes a parallel link. The plate spring 16 is located lower than the first upper link 22 and the second upper link 24 and higher than the first lower link 23 and the second lower link 25. In the bogie 1 supporting the carbody 3 in the empty car state, the links 22 to 25 extend horizontally.

The first axle box 14 further includes: a first upper supporting portion 14*c* connected to the first upper link 22; and a first lower supporting portion 14*d* connected to the first lower link 23. The second axle box 15 further includes: a second upper supporting portion 15*c* connected to the second upper link 24; and a second lower supporting portion 15*d* connected to the second lower link 25. The first upper supporting portion 14*c* is provided at an upper side of the first main body portion 14*a*, and the second upper supporting portion 15*c* is provided at an upper side of the second main body portion 15*a*. The first lower supporting portion 14*d* is provided at a lower side of the first main body portion 14*a*, and the second lower supporting portion 15*d* is provided at a lower side of the second main body portion 15*a*. A first upper elastic member 26 is interposed between the first upper link 22 and the first upper supporting portion 14*c*, and a first lower elastic member 27 is interposed between the first lower link 23 and the first lower supporting portion 14*d*. A second upper elastic member 28 is interposed between the second upper link 24 and the second upper supporting portion 15*c*, and a second lower elastic member 29 is interposed between the second lower link 25 and the second lower supporting portion 15*d*.

Each of the end portions 5*a* of the cross beam 5 includes: a first upper supporting portion 5*b* connected to the first upper link 22; a second upper supporting portion 5*c* connected to the second upper link 24; a first lower supporting portion 5*d* connected to the first lower link 23; and a second lower supporting portion 5*e* connected to the second lower link 25. A first upper elastic member 30 is interposed between the first upper link 22 and the first upper supporting portion 5*b*, and a first lower elastic member 31 is interposed between the first lower link 23 and the first lower supporting portion 5*d*. A second upper elastic member 32 is interposed between the second upper link 24 and the second upper supporting portion 5*c*, and a second lower elastic member 33 is interposed between the second lower link 25 and the second lower supporting portion 5*e*. In the present embodiment, the elastic members 26 to 33 are cylindrical rubber bushings each arranged so as to have an axis extending in the car width direction.

The first upper supporting portion 14*c* of the first axle box 14 includes a tubular portion 14*ca* having an axis extending in the car width direction. A car longitudinal direction outer end portion 22*a* (first end portion) of the first upper link 22 includes a shaft portion 22*aa* extending in the car width direction and inserted through the tubular portion 14*ca* with a gap. The first upper elastic member 26 that is the rubber bushing is interposed between the tubular portion 14*ca* and the shaft portion 22*aa*. Since states of coupling the supporting portions 14*c*, 14*d*, 15*c*, and 15*d* of the first and second axle boxes 14 and 15 to the respective links 22, 23, 24, and 25 are the same as one another, the other explanations are omitted.

A car longitudinal direction inner end portion 22*b* (second end portion) of the first upper link 22 includes a tubular portion 22*ba* having an axis extending in the car width direction. The first upper supporting portion 5*b* of the cross beam 5 includes a shaft portion 5*ba* extending in the car width direction and inserted through the tubular portion 22*ba* with a gap. The elastic member 30 that is the rubber bushing is interposed between the tubular portion 22*ba* and the shaft portion 5*ba*. Since states of coupling the supporting portions 5*b*, 5*c*, 5*d*, and 5*e* of the cross beam 5 to the respective links 22, 23, 24, and 25 are the same as one another, the other explanations are omitted.

The first upper supporting portion 14*c* and first lower supporting portion 14*d* of the first axle box 14 are arranged on a first virtual straight line L1 passing through a center of the first axle 8 in a side view, and the second upper supporting portion 15*c* and the second lower supporting portion 15*d* are arranged on a second virtual straight line L2 passing through a center of the second axle 9 in a side view. Specifically, the tubular portion 14*ca* of the first upper supporting portion 14*c* and a tubular portion of the first lower supporting portion 14*d* are arranged on the first virtual straight line L1 in a side view (the same is true for the second virtual straight line L2). As a result, a coupling point P1 where the first end portion of the first upper link 22 and the first axle box 14 are coupled to each other and a coupling point P2 where the first end portion of the first lower link 23 and the first axle box 14 are coupled to each other are located on the first virtual straight line L1 in a side view, and a coupling point P3 where the first end portion of the second upper link 24 and the second axle box 15 are coupled to each other and a coupling point P4 where the first end portion of the second lower link 25 and the second axle box 15 are coupled to each other are located on the second virtual straight line L2 in a side view. The coupling point P1 (P2, P3, P4) coincides with a turning fulcrum about which the link 22 (23, 24, 25) turns relative to the axle box 14 (15).

Further, the first upper supporting portion 14*c* and the first lower supporting portion 14*d* are arranged so as to be displaced from a vertical line V1 passing through the center of the first axle 8 in a side view, and the second upper supporting portion 15*c* and the second lower supporting portion 15*d* are arranged so as to be displaced from a vertical line V2 passing through the center of the second axle 9 in a side view. To be specific, the coupling points P1 and P2 are arranged so as to be displaced from the vertical line V1 in a side view, and the coupling points P3 and P4 are arranged so as to be displaced from the vertical line V2 in a side view. With this, the virtual straight line L1 is inclined with respect to the vertical line V1 about the axle 8, and the virtual straight line L2 is inclined with respect to the vertical line V2 about the axle 9. Specifically, the first upper supporting portion 14*c* is located at an outer side of the vertical line V1 in the car longitudinal direction, and the second upper supporting portion 15*c* is located at an outer side of the vertical line V2 in the car longitudinal direction. The first lower supporting portion 14*d* is located at an inner side of the vertical line V1 in the car longitudinal direction, and the second lower supporting portion 15*d* is located at an inner side of the vertical line V2 in the car longitudinal direction.

The first upper supporting portion 5*b* and first lower supporting portion 5*d* of the cross beam 5 are arranged on a third virtual straight line L3 parallel to the first virtual straight line L1 in a side view, and the second upper supporting portion 5*c* and second lower supporting portion 5*e* of the cross beam 5 are arranged on a fourth virtual straight line L4 parallel to the second virtual straight line L2 in a side view. To be specific, the third virtual straight line L3 connecting a coupling point P5 where the second end portion of the first upper link 22 and the cross beam 5 are coupled to each other and a coupling point P6 where the second end portion of the first lower link 23 and the cross beam 5 are coupled to each other is parallel to the first virtual straight line L1, and the fourth virtual straight line L4 connecting a coupling point P7 where the second end portion of the second upper link 24 and the cross beam 5 are coupled to each other and a coupling point P8 where the second end portion of the second lower link 25 and the cross beam 5 are coupled to each other is parallel to the second virtual straight line L2.

The first upper elastic member 30 and the first lower elastic member 31 are arranged so as to sandwich the first axle 8 in a side view, and the second upper elastic member 32 and the second lower elastic member 33 are arranged so as to sandwich the second axle 9 in a side view. Specifically, the first upper elastic member 30 and the first lower elastic member 31 are arranged point-symmetrically with respect to the center of the first axle 8 in a side view, and the second upper elastic member 32 and the second lower elastic member 33 are arranged point-symmetrically with respect to the center of the second axle 9 in a side view.

As shown in FIGS. 2 and 3, each of both end portions 5*a* of the cross beam 5 includes: a side wall portion 5*f* extending downward; an upper wall portion 5*g* projecting from an upper portion of the side wall portion 5*f* outward in the car width direction; and a lower wall portion 5*h* projecting from a lower portion of the side wall portion 5*f* outward in the car width direction. An amount of projection of the lower wall portion 5*h* from the side wall portion 5*f* outward in the car width direction is smaller than an amount of projection of the upper wall portion 5*g* from the side wall portion 5*f* outward in the car width direction. The air spring 2 is mounted on an upper surface of the upper wall portion 5*g*, and the pressing member 21 is fixed to a lower surface of the upper wall portion 5*g*. The lower wall portion 5*h* includes a tapered portion 5*ha* formed such that a clearance between the tapered portion 5*ha* and the upper wall portion 5*g* increases toward a car width direction outer tip end of the tapered portion 5*ha*. A plate spring insertion space S is formed between the pressing member 21 and the lower wall portion 5*h*. The plate spring 16 is inserted into the plate spring insertion space S, and the plate spring insertion space S is open outward in the car width direction. The plate spring 16 arranged in the plate spring insertion space S is in contact with the pressing surface 21*a* of the pressing member 21 and is spaced upward apart from the lower wall portion 5*h*.

The lower wall portion 5*h* is shorter than the upper wall portion 5*g* in the car longitudinal direction. The first upper link 22 and the second upper link 24 are coupled to both respective car longitudinal direction end portions of the upper wall portion 5*g*, and the first lower link 23 and the second lower link 25 are coupled to both respective car longitudinal direction end portions of the lower wall portion 5*h*. A jack pad 34 is provided on a lower surface of the cross beam 5, and a jack device (not shown) configured to lift the cross beam 5 is pressed against the jack pad 34. Specifically, a reinforcing member 5*j* is connected to a car width direction inner side surface of the side wall portion 5*f* and the lower surface of the cross beam 5, and the jack pad 34 is attached to a lower surface of the reinforcing member 5*j*. The jack pad 34 is attached to the bogie 1 such that the position of the jack pad 34 coincide with each of the positions of wheel treads of the wheels 10 and 11 in the car width direction. Therefore, when jacking up the cross beam 5 on the rail, the jack device is placed on an upper surface of the rail and pushes up the jack pad 34 located immediately above the jack device. Thus, the cross beam 5 can be lifted stably.

The air spring 2 is arranged such that an upper surface 2*a* of the air spring 2 is lower than upper ends of the first wheels 10 and upper ends of the second wheels 11. To be specific, the upper ends of the wheels 10 and 11 are arranged higher than a lower surface of an underframe 3*a* of the carbody 3 (FIG. 3). Spaces are formed at the underframe 3*a* so as to be located at positions corresponding to the wheels 10 and 11, and the upper ends of the wheels 10 and 11 are located at the respective spaces.

Auxiliary devices 35 are connected to the first axle boxes 14 and the second axle boxes 15. Each of the auxiliary devices 35 is required to be located at a certain height from a track. Examples of the auxiliary device 35 include a rail guard and a snow plough (FIG. 2 shows only the auxiliary devices 35 connected to the second axle boxes 15, but the auxiliary devices 35 are connected also to the first axle boxes 14.).

According to the above-explained configurations, the links 22 to 25 serving as the coupling members connecting the cross beam 5 and the axle boxes 14 and 15 and the plate springs 16 supporting the pressing members 21 of the cross beam 5 from below have simple configurations each extending in the car longitudinal direction. Therefore, the low floor of the railcar can be easily realized by lowering the position of the cross beam 5, and the weight reduction can be realized. The first upper elastic member 26 is interposed between the first upper link 22 and the first axle box 14, and the first lower elastic member 27 is interposed between the first lower link 23 and the first axle box 14. Further, the second upper elastic member 28 is interposed between the second upper link 24 and the second axle box 15, and the second lower elastic member 29 is interposed between the second lower link 25 and the second axle box 15. Therefore, by the elastic deformation of the elastic members 26 to 29, the first wheelset 6 and the second wheelset 7 can be angularly displaced relative to the cross beam 5 in a steering direction. Then, the first upper supporting portion 14*c* and the first lower supporting portion 14*d* are arranged on the first virtual straight line L1 passing through the center of the first axle 8 in a side view, and the second upper supporting portion 15*c* and the second lower supporting portion 15*d* are arranged on the second virtual straight line L2 passing through the center of the second axle 9 in a side view. Therefore, even when the bogie 1 travels in any direction along the car longitudinal direction, the wheelsets 6 and 7 are naturally and smoothly steered (turned) along a leftward/rightward direction curve of the track using the virtual straight lines L1 and L2 as reference lines. On this account, lateral force from the track can be effectively reduced, and a curved line passing performance can be improved.

The plate spring 16 supports the pressing member 21, provided at the cross beam 5, from below so as to be displaceable relative to the pressing member 21. Further, the first axle box 14 and the cross beam 5 are connected to each other by a pair of upper and lower links 22 and 23, and the second axle box 15 and the cross beam 5 are connected to each other by a pair of upper and lower links 24 and 25. Therefore, twisting force is hardly transferred between the cross beam 5 and the plate spring 16, and the axle boxes 14 and 15 of the bogie 1 can be independently and smoothly displaced in the vertical direction. Further, by the above-described effect of the load balance by the rotation of the plate spring 16, the wheels 10 and 11 easily follow, for example, ups and downs of the track. Thus, the decrease of wheel load can be effectively prevented.

The circular-arc pressing surface 21*a* of the pressing member 21 is placed on the plate spring 16 from above so as to be displaceable relative to the plate spring 16. Therefore, even when the height difference is generated between the front and rear wheels 10 and 11, the plate spring 16 rotates with respect to the pressing surface 21*a* of the pressing member 21, so that the decrease of wheel load can be prevented. In this case, the cross beam 5 is coupled to the first axle box 14 and the second axle box 15 by the links 22 to 25. Therefore, even when the railcar accelerates or decelerates, the turning of the cross beam 5 about an axis extending in the car width direction can be prevented, and the posture of the cross beam 5 can be maintained constant. Further, vibrations of the carbody when the railcar accelerates and decelerates can be suppressed.

The set of the first upper link 22 and the first lower link 23 constitutes a parallel link, and the set of the second upper link 24 and the second lower link 25 constitutes a parallel link. Therefore, when the plate spring 16 elastically deforms, the first axle box 14 and the second axle box 15 are displaced relative to the cross beam 5 in the vertical direction while maintaining certain postures of the first axle box 14 and the second axle box 15 relative to the cross beam 5. On this account, even when the auxiliary devices 35 are attached to the first axle box 14 and the second axle box 15, each of the auxiliary devices 35 can be maintained at a certain height from the track.

The first spring supporting portion 14*b* projects from the first main body portion 14*a* toward the middle side in the car longitudinal direction to support the end portion 16*b* of the plate spring 16, and the second spring supporting portion 15*b* projects from the second main body portion 15*a* toward the middle side in the car longitudinal direction to support the end portion 16*c* of the plate spring 16. Therefore, the length of the plate spring 16 can be shortened, and the cost for the plate spring 16 can be reduced. Further, the plate spring 16 has such a shape that in the no-load state, the upper surface of the plate spring 16 is the horizontal flat surface, and the lower surface of the plate spring 16 includes the circular-arc surface that is convex downward. Therefore, by producing the plate spring 16 using the upper surface that is the horizontal flat surface as a production reference surface, the plate spring 16 can be easily formed with a high degree of accuracy.

Since the plate spring 16 is arranged between a set of the upper links 22 and 24 and a set of the lower links 23 and 25 in a side view, the cross beam 5 can be arranged at a low position. Further, the first upper supporting portion 14*c* and the first lower supporting portion 14*d* are arranged so as to be displaced from the vertical line V1 passing through the center of the first axle 8 in a side view, and the second upper supporting portion 15*c* and the second lower supporting portion 15*d* are arranged so as to be displaced from the vertical line V2 passing through the center of the second axle 9 in a side view. Therefore, the upper link 22 and the lower link 23 can be arranged close to each other, and the upper link 24 and the lower link 25 can be arranged close to each other. With this, the cross beam 5 can be arranged at a low position. Further, since the upper surfaces 2*a* of the air springs 2 are located lower than the upper ends of the first wheels 10 and the upper ends of the second wheels 11, a floor surface of the carbody 3 can be arranged at a low position.

The upper link 22 extends outward in the car longitudinal direction beyond the center of the axle 8, and the upper link 24 extends outward in the car longitudinal direction beyond the axle 9. With this, even when the cross beam 5 is arranged at a low position by coupling the upper links 22 and 24 to portions located just beside the cross beam 5 which is required to have such a size in the car longitudinal direction that the air springs 2 can be placed on the cross beam 5, the upper links 22 and 24 can be made long. Thus, even when the links 22 to 25 are displaced in the vertical direction by the elastic deformation of the plate spring 16, a change in a wheel base can be suppressed. Therefore, even when loads applied to the left and right air springs 2 by left/right movements of the carbody 3 change while the railcar is linearly traveling, the generation of a difference between the left and right wheel bases can be suppressed.

Each of both end portions 5*a* of the cross beam 5 includes the upper wall portion 5*g*, the side wall portion 5*f*, and the lower wall portion 5*h*, and the pressing member 21 is provided on the lower surface of the upper wall portion 5*g*. Further, the plate spring insertion space S that is open outward in the car width direction is formed between the pressing member 21 and the lower wall portion 5*h*. Therefore, the plate spring 16 can be taken out from the plate spring insertion space S outward in the car width direction without disassembling the bogie 1. To be specific, the plate spring 16 can be easily taken out from the plate spring insertion space S outward in the car width direction in such a manner that: the cross beam 5 is lifted by pressing the jack device (not shown) against the jack pad 34 from below; and the pressing force applied from the pressing member 21 to the plate spring 16 is released. For example, when there exists a busy period and a slack period, and a change in the number of passengers is known, the plate spring 16 can be easily replaced with a plate spring having a different spring constant in accordance with a change in a load applied from the carbody to the bogie. Thus, the ride quality can be easily adjusted. Therefore, the ease of maintenance of the plate spring 16 improves.

The first upper link 22 and the second upper link 24 are coupled to the upper wall portion 5*g*, and the first lower link 23 and the second lower link 25 are coupled to the lower wall portion 5*h*. Force from the links 22 to 25 in a horizontal direction is easily received by the cross beam 5. Therefore, the strength requirement of the bogie 1 can be relaxed, and this can realize the weight reduction. Further, since the reinforcing member 5*j* is connected to the car width direction inner side surface of the side wall portion 5*f* and the lower surface of the cross beam 5, the reinforcing member 5*j* can receives loads from the links 22 to 25.

The wheel base of the bogie 1 can be easily changed depending on the type of the railcar in such a manner that: the lengths of the links 22 to 25 are changed; or an interval between the set of the front links 22 and 23 and the set of the rear links 24 and 25 is changed. In this case, the spring constant of the plate spring 16 can be easily adjusted to a desired value by changing the lengths of the end portions 16*b* and 16*c* of the plate spring 16 and the width of the plate spring 16.

Embodiment 2

Figure 4:
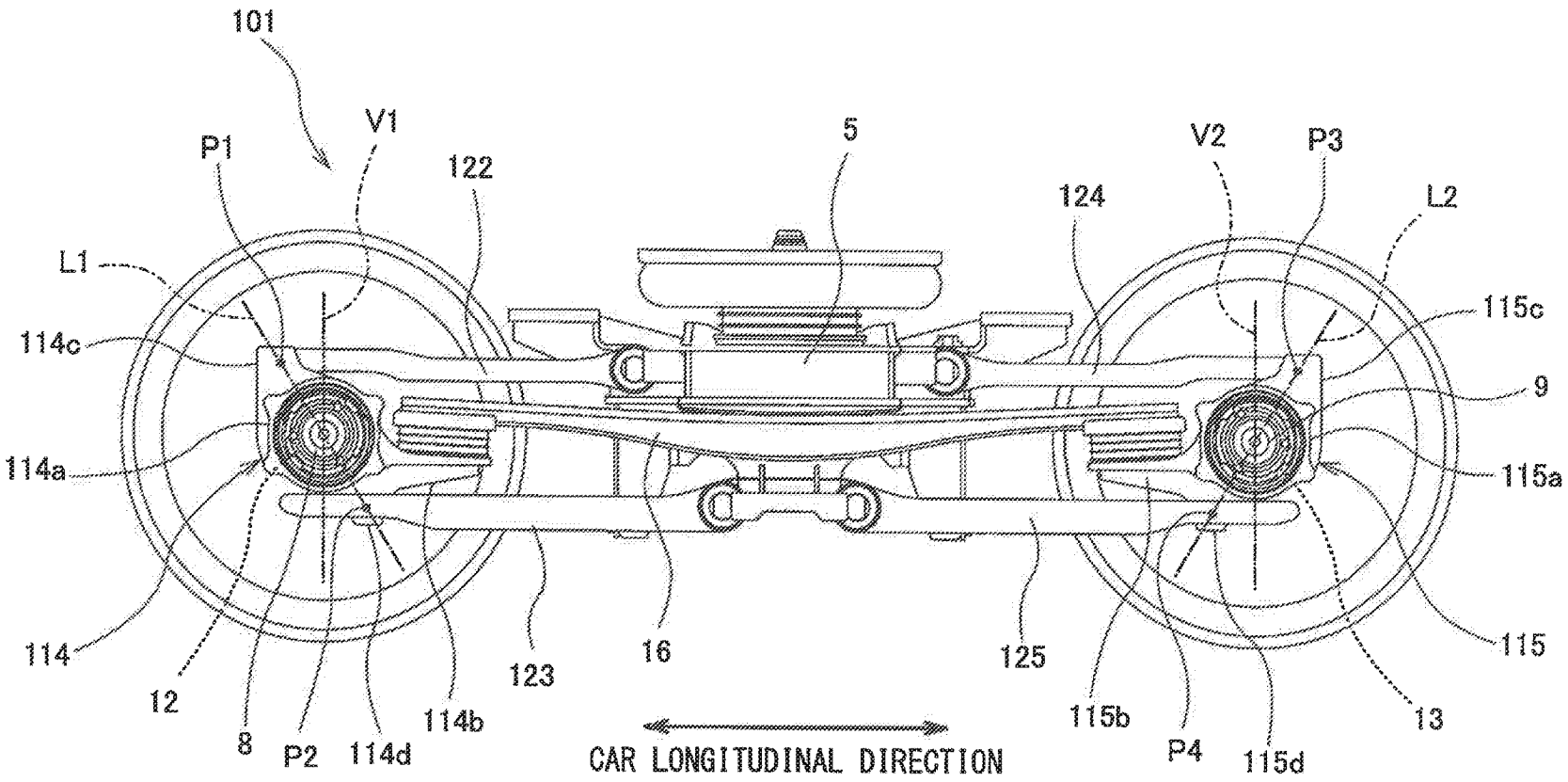
FIG. 4 is a side view showing the bogie for the railcar according to Embodiment 2.
Figure 5:
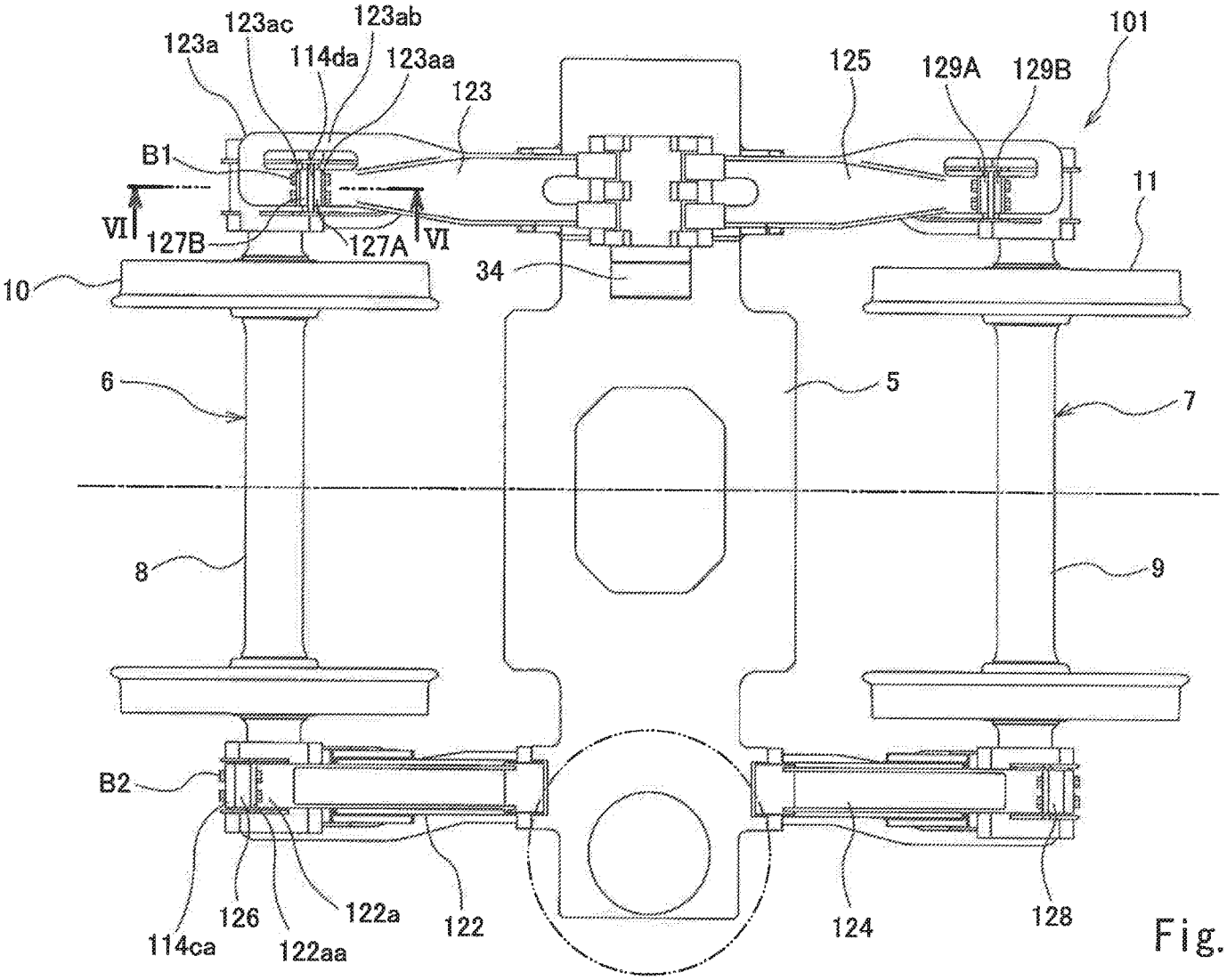
FIG. 5 is a plan view showing the bogie of FIG. 4. An upper half of FIG. 5 is a diagram when viewed from below, and a lower half of FIG. 5 is a diagram when viewed from above.

FIG. 4 is a side view showing a bogie 101 for a railcar according to Embodiment 2. FIG. 5 is a plan view showing the bogie 101 of FIG. 4. An upper half of FIG. 5 is a diagram when viewed from below, and a lower half of FIG. 5 is a diagram when viewed from above. As shown in FIGS. 4 and 5, states of coupling links 122 to 125 to axle boxes 114 and 115 in the bogie 101 of Embodiment 2 are different from those in the bogie 1 of Embodiment 1.

The cross beam 5 and the first axle box 114 are coupled to each other by a pair of a first upper link 122 and a first lower link 123 so as to be turnable, the first upper link 122 and the first lower link 123 extending in the car longitudinal direction. The cross beam 5 and the second axle box 115 are coupled to each other by a pair of a second upper link 124 and a second lower link 125 so as to be turnable, the second upper link 124 and the second lower link 125 extending in the car longitudinal direction.

The first axle box 114 includes: a first main body portion 114*a* accommodating the first bearing 12; a first spring supporting portion 114*b* projecting from the first main body portion 114*a* toward the middle side in the car longitudinal direction and supporting the first end portion of the plate spring 16 from below; a first upper supporting portion 114*c* connected to the first upper link 122; and a first lower supporting portion 114*d* connected to the first lower link 123. The second axle box 115 includes: a second main body portion 115*a* accommodating the first bearing 13; a second spring supporting portion 115*b* projecting from the second main body portion 115*a* toward the middle side in the car longitudinal direction and supporting the second end portion of the plate spring 16 from below; and a second upper supporting portion 115*c* connected to the second upper link 124; and a second lower supporting portion 115*d* connected to the second lower link 125.

A car longitudinal direction outer end portion 122*a* of the first upper link 122 includes a vertical wall portion 122*aa* facing in the car longitudinal direction. The first upper supporting portion 114*c* of the first axle box 114 includes a vertical wall portion 114*ca* opposed to the vertical wall portion 122*aa* of the first upper link 122 from an outer side in the car longitudinal direction. A first upper elastic member 126 that is a rubber plate is sandwiched between the vertical wall portion 122*aa* of the first upper link 122 and the vertical wall portion 114*ca* of the first upper supporting portion 114*c*. Then, a state where a pair of vertical wall portions 114*ca* and 122*aa* sandwich the first upper elastic member 126 in the car longitudinal direction is maintained by bolts B2 penetrating the vertical wall portion 114*ca*, the first elastic member 126, and the vertical wall portion 122*aa*. To be specific, the first upper elastic member 126 is interposed between the first upper link 122 and the first upper supporting portion 114*c*. Since a state of coupling the second upper supporting portion 115*c* of the second axle box 115 to the second upper link 124 is the same as above, a detailed explanation thereof is omitted.

Figure 6:
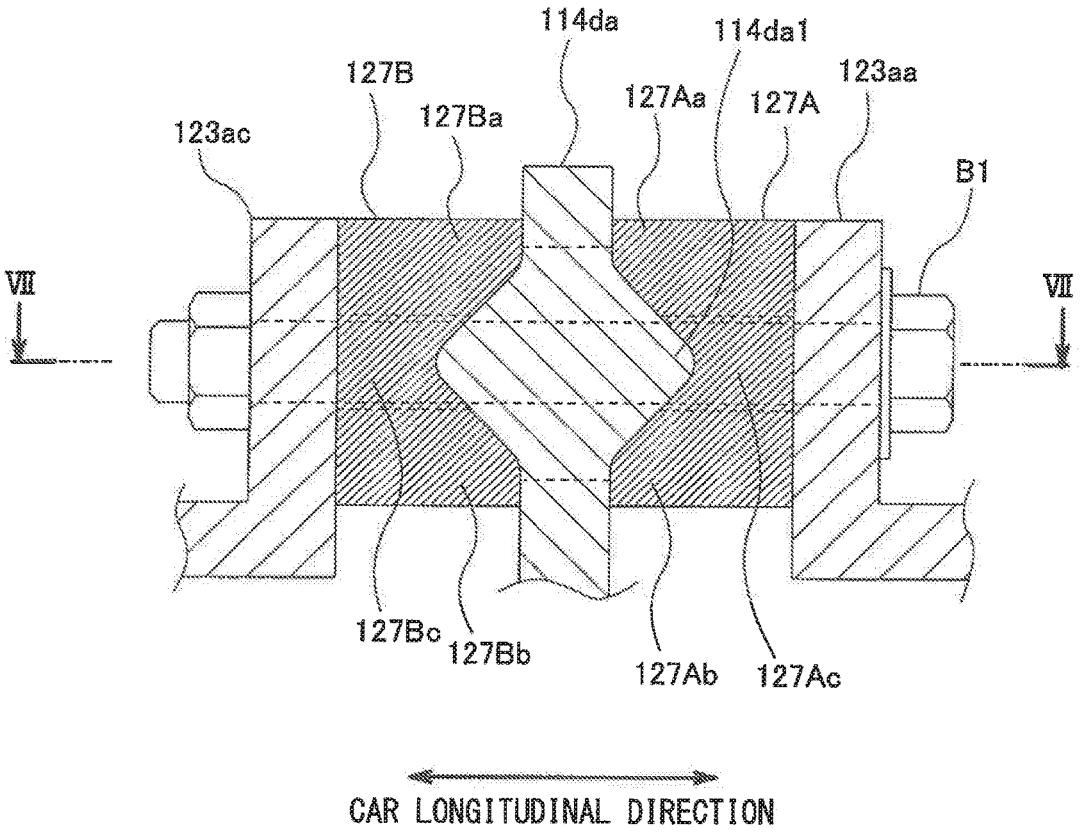
FIG. 6 is a sectional view taken along line VI-VI of FIG. 5.
Figure 7:
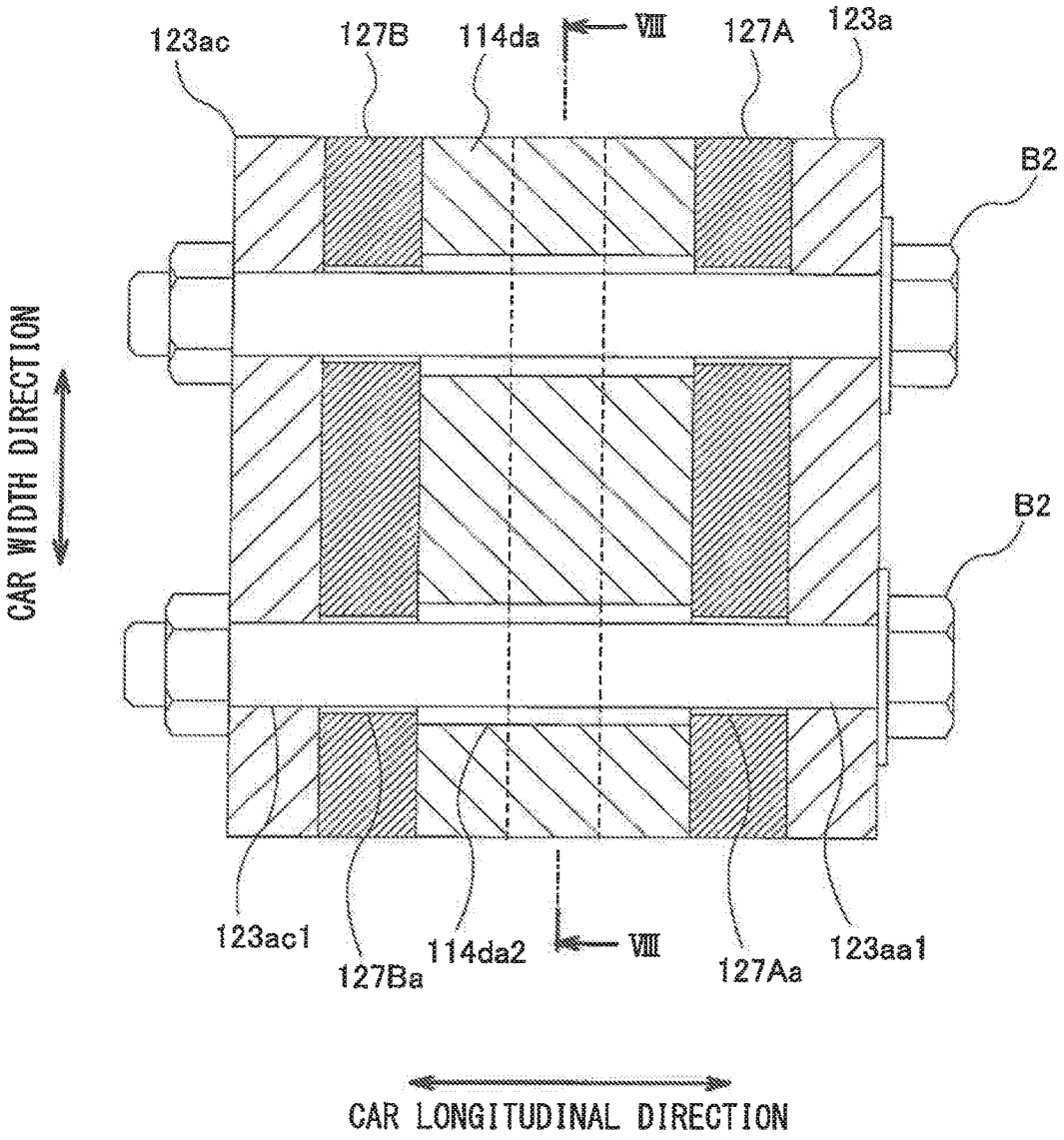
FIG. 7 is a sectional view taken along line VII-VII of FIG. 6.
Figure 8:
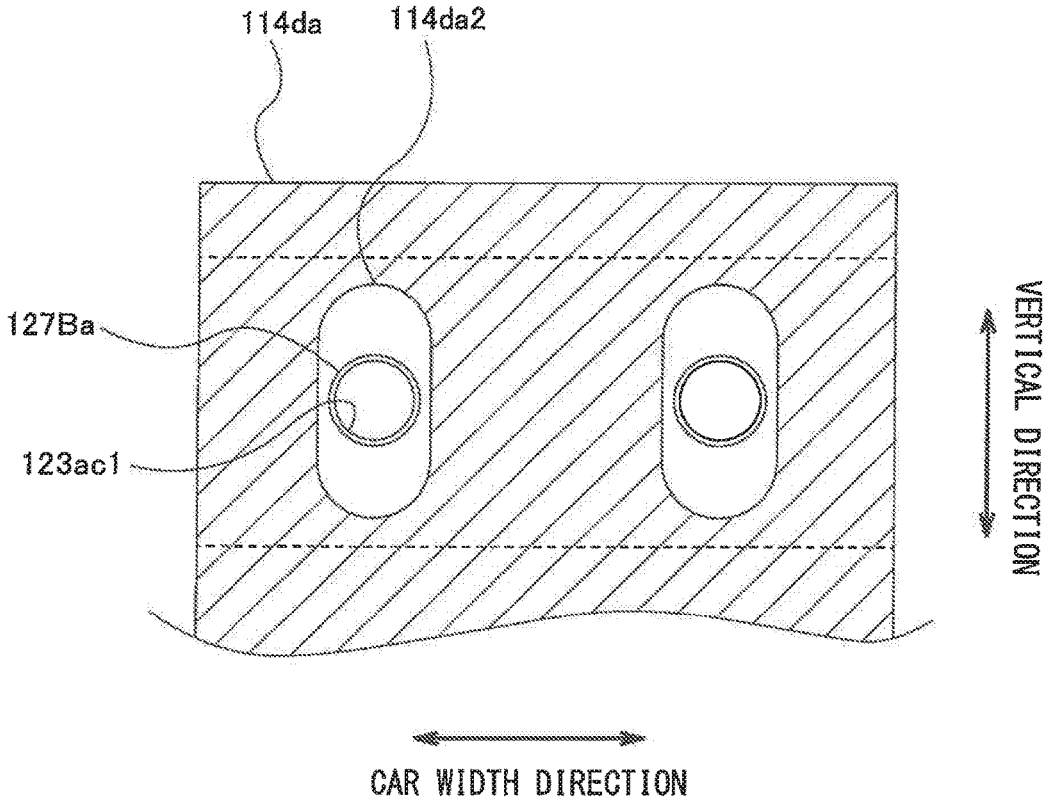
FIG. 8 is a sectional view taken along line VIII-VIII of FIG. 7.

FIG. 6 is a sectional view taken along line VI-VI of FIG. 5. FIG. 7 is a sectional view taken along line VII-VII of FIG. 6. FIG. 8 is a sectional view taken along line VIII-VIII of FIG. 7. As shown in FIGS. 5 to 8, the first lower supporting portion 114*d* includes a vertical wall portion 114*da* having a normal line extending in the car longitudinal direction. A car longitudinal direction outer end portion 123*a* of the first lower link 123 has a C shape in a plan view and sandwiches the vertical wall portion 114*da* of the first lower supporting portion 114*d* from both sides in the car longitudinal direction. Specifically, the outer end portion 123*a* includes: an inner vertical wall portion 123*aa* opposed to the vertical wall portion 114*da* of the first lower supporting portion 114*d* from an inner side in the car longitudinal direction; an outer vertical wall portion 123*ac* opposed to the vertical wall portion 114*da* of the first lower supporting portion 114*d* from an outer side in the car longitudinal direction; and a bypass portion 123*ab* bypassing the vertical wall portion 114*da* of the first lower supporting portion 114*d* at an outer side in the car width direction to integrally connect the inner vertical wall portion 123*aa* and the outer vertical wall portion 123*ac*.

A first lower elastic member 127A that is a rubber plate is sandwiched between the inner vertical wall portion 123*aa* and the vertical wall portion 114*da*, and a first lower elastic member 127B is sandwiched between the outer vertical wall portion 123*ac* and the vertical wall portion 114*da*. A state where the vertical wall portions 123*aa*, 114*da*, and 123*ac* sandwich the first elastic members 127A and 127B in the car longitudinal direction is maintained by bolts B1 penetrating the inner vertical wall portion 123*aa*, the first lower elastic member 127A, the vertical wall portion 114*da*, the first lower elastic member 127B, and the outer vertical wall portion 123*ac*. To be specific, the first lower elastic members 127A and 127B are interposed between the first lower link 123 and the first lower supporting portion 114*d*.

The first lower elastic member 127A has such a shape that a vertical direction middle portion 127Ac thereof is thinner than each of upper and lower end portions 127Aa and 127Ab thereof in the car longitudinal direction, and the first lower elastic member 127B has such a shape that a vertical direction middle portion 127Bc thereof is thinner than each of upper and lower end portions 127Ba and 127Bb thereof in the car longitudinal direction. Specifically, the middle portion 127Ac of the first lower elastic member 127A has a surface opposed to the vertical wall portion 114*da* and depressed in the car longitudinal direction to have a V-shaped cross section. Similarly, the middle portion 127Bc of the first lower elastic member 127B has a surface opposed to the vertical wall portion 114*da* and depressed in the car longitudinal direction to have a V-shaped cross section. It should be noted that each of these surfaces may be depressed to have a circular-arc cross section instead of the V-shaped cross section. The vertical wall portion 114*da* of the first lower supporting portion 114*d* of the first axle box 114 has such a shape that a vertical direction middle portion 114*da*1 thereof project toward both sides in the car longitudinal direction so as to fit the middle portions 127Ac and 127Bc of the first elastic members 127A and 127B. In the present embodiment, the middle portion 114*da*1 of the vertical wall portion 114*da* projects to have a V-shaped cross section.

Each of bolt insertion holes 114*da*2 of the vertical wall portion 114*da* of the first lower supporting portion 114*d* is larger in both the vertical direction and the car width direction than each of bolt insertion holes 123*aa*1 and 123*ac*1 of the vertical wall portions 123*aa* and 123*ac* of the first lower link 123 and bolt insertion holes 127Aa and 127Ba of the first elastic members 127A and 127B. The bolt insertion hole 114*da*2 of the vertical wall portion 114*da* of the first lower supporting portion 114*d* has a vertically long shape that is larger in the vertical direction than in the car width direction. When the first lower link 123 vertically swings by the elastic deformation of the plate spring 16, the first lower link 123 moves using the middle portion 114*da*1 of the vertical wall portion 114*da* of the first lower supporting portion 114*d* as a fulcrum. Since a state of coupling the second lower supporting portion 115*d* of the second axle box 115 to the second lower link 125 is the same as above, a detailed explanation thereof is omitted.

The first upper supporting portion 114*c* and first lower supporting portion 114*d* of the first axle box 114 are arranged on the first virtual straight line L1 passing through the center of the first axle 8 of the first wheelset 6 in a side view, and the second upper supporting portion 115*c* and the second lower supporting portion 115*d* are arranged on the second virtual straight line L2 passing through the center of the second axle 9 of the second wheelset 7 in a side view. Specifically, the vertical wall portion 114*ca* of the first upper supporting portion 114*c* and the vertical wall portion 114*da* of the first lower supporting portion 114*d* are arranged on the first virtual straight line L1 in a side view (the same is true for the second virtual straight line L2). As a result, a coupling point P1 where the first end portion of the first upper link 122 and the first axle box 114 are coupled to each other and a coupling point P2 where the first end portion of the first lower link 123 and the first axle box 114 are coupled to each other are located on the first virtual straight line L1 in a side view, and a coupling point P3 where the first end portion of the second upper link 124 and the second axle box 115 are coupled to each other and a coupling point P4 where the first end portion of the second lower link 125 and the second axle box 115 are coupled to each other are located on the second virtual straight line L2 in a side view.

Further, the first upper supporting portion 114*c* and the first lower supporting portion 114*d* are arranged so as to be displaced from the vertical line V1 passing through the center of the first axle 8 in a side view, and the second upper supporting portion 115*c* and the second lower supporting portion 115*d* are arranged so as to be displaced from the vertical line V2 passing through the center of the second axle 9 in a side view. Specifically, the first upper supporting portion 114*c* is located at an outer side of the vertical line V1 in the car longitudinal direction, and the second upper supporting portion 115*c* is located at an outer side of the vertical line V2 in the car longitudinal direction. The first lower supporting portion 114*d* is located at an inner side of the vertical line V1 in the car longitudinal direction, and the second lower supporting portion 115*d* is located at an inner side of the vertical line V2 in the car longitudinal direction.

According to the above-explained configuration, the first wheelset 6 and the second wheelset 7 can be angularly displaced relative to the cross beam 5 in the steering direction by the elastic deformation of the elastic members 126 to 129. Further, the first upper supporting portion 114*c* and the first lower supporting portion 114*d* are arranged on the first virtual straight line L1 passing through the center of the first axle 8 in a side view, and the second upper supporting portion 115*c* and the second lower supporting portion 115*d* are arranged on the second virtual straight line L2 passing through the center of the second axle 9 in a side view. Therefore, even when the bogie 1 travels in any direction along the car longitudinal direction, the wheelsets 6 and 7 are naturally and smoothly steered along a leftward/rightward direction curve of the track using the virtual straight lines L1 and L2 as reference lines. On this account, the lateral force form the track can be effectively reduced.

Further, the first lower link 123 includes the outer end portion having a C shape in a plan view and sandwiching the first lower supporting portion 114*d* from both sides in the car longitudinal direction, and the second lower link 125 includes the outer end portion having a C shape in a plan view and sandwiching the second lower supporting portion 115*d* from both sides in the car longitudinal direction. Therefore, even if the bolts B1 come off, the first lower link 123 can be prevented from being detached from the first axle box 114 in the car longitudinal direction, and the second lower link 125 can be prevented from being detached from the second axle box 115 in the car longitudinal direction.

Further, the first lower elastic members 127A and 127B (and second lower elastic members 129A and 129B) have such shapes that: the vertical direction middle portion 127Ac is thinner than each of the upper end portion 127Aa and the lower end portion 127Ab in the car longitudinal direction; and the vertical direction middle portion 127Bc is thinner than each of the upper end portion 127Ba and the lower end portion 127Bb in the car longitudinal direction. Therefore, the first lower elastic member 127A elastically deforms easily using the middle portion 127Ac as a fulcrum, and the first lower elastic member 127B elastically deforms easily using the middle portion 127Bc as a fulcrum. On this account, when the first lower link 123 vertically swings by the elastic deformation of the plate spring 16, the first lower link 123 can swing based on a stable fulcrum. It should be noted that since the other components are the same as those in Embodiment 1, explanations thereof are omitted.

Embodiment 3

Figure 9:
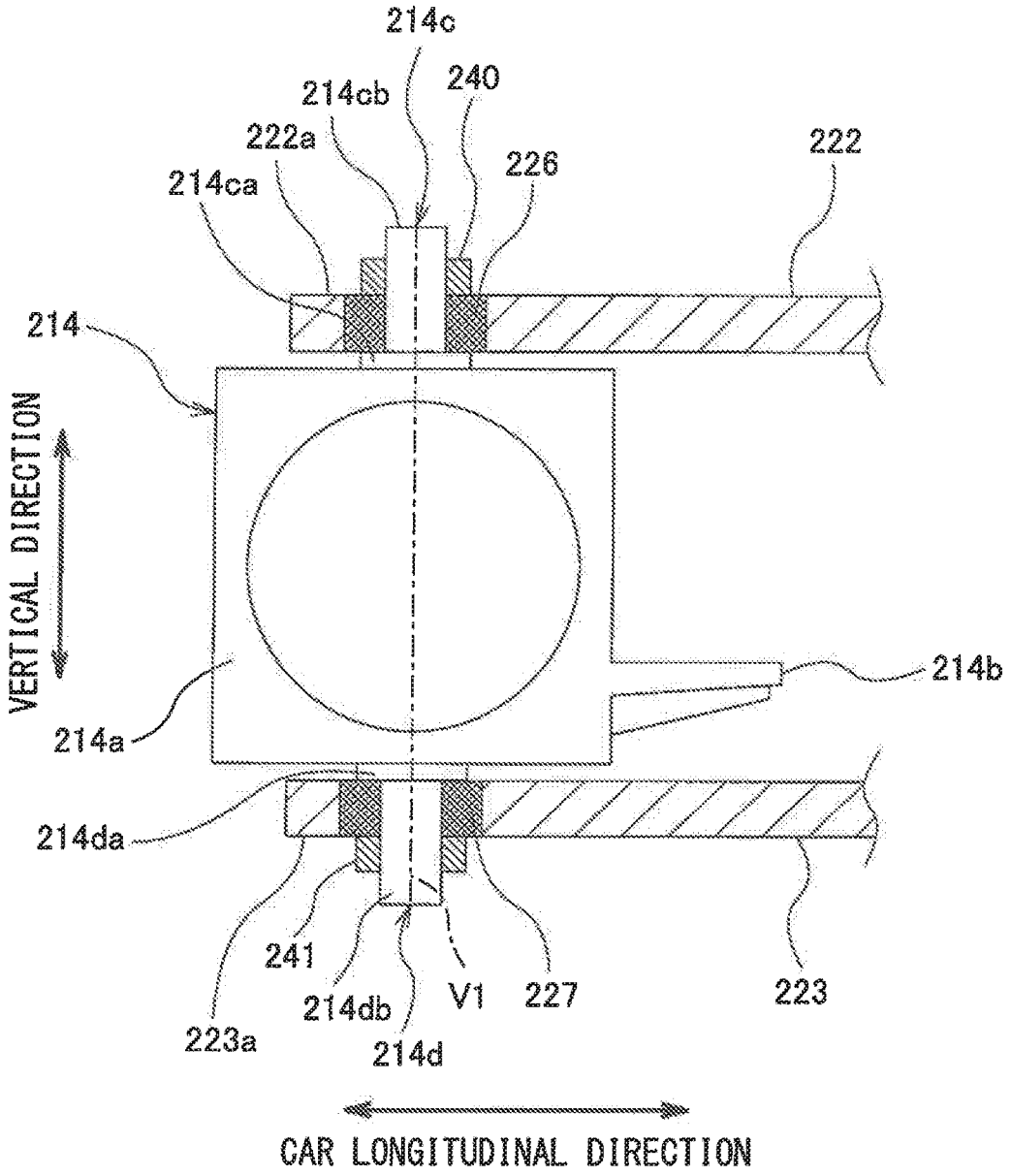
FIG. 9 is an enlarged schematic side view showing a state where an axle box and links are coupled to one another in the bogie for the railcar according to Embodiment 3.

FIG. 9 is an enlarged schematic side view showing a state where an axle box 214 and links 222 and 223 are coupled to one another in the bogie for the railcar according to Embodiment 3. As shown in FIG. 9, the first axle box 214 of Embodiment 3 includes: a first main body portion 214*a*; a first spring supporting portion 214*b*; a first upper supporting portion 214*c* connected to the first upper link 222; and a first lower supporting portion 214*d* connected to the first lower link 223.

The first upper supporting portion 214*c* includes: a base portion 214*ca* projecting on an upper surface of the first main body portion 214*a*; and a shaft portion 214*cb* projecting upward from the base portion 214*ca* and smaller in diameter than the base portion 214*ca*. The first lower supporting portion 214*d* includes: a base portion 214*da* projecting on a lower surface of the first main body portion 214*a*; and a shaft portion 214*db* projecting downward from the base portion 214*da* and smaller in diameter than the base portion 214*da*. A car longitudinal direction outer end portion 222*a* of the first upper link 222 includes a tubular portion having an axis extending in the vertical direction, and a car longitudinal direction outer end portion 223*a* of the first lower link 223 includes a tubular portion having an axis extending in the vertical direction. A first upper elastic member 226 that is a tubular rubber bushing is interposed between the tubular outer end portion 222*a* and the shaft portion 214*cb*, and a first lower elastic member 227 that is a tubular rubber bushing is interposed between the tubular outer end portion 223*a* and the shaft portion 214*db*.

A nut member 240 threadedly engaged with the shaft portion 214*cb* is in contact with an upper surface of the first upper elastic member 226, and a nut member 241 threadedly engaged with the shaft portion 214*db* is in contact with a lower surface of the first lower elastic member 227. To be specific, the first upper elastic member 226 is sandwiched between the base portion 214*ca* and the nut member 240, and the first lower elastic member 227 is sandwiched between the base portion 214*da* and the nut member 241. Each of outer diameters of the base portion 214*ca* and the nut member 240 is smaller than an outer diameter of the first upper elastic member 226, and each of outer diameters of the base portion 214*da* and the nut member 241 is smaller than an outer diameter of the first lower elastic member 227. The shaft portion 214*cb* of the first upper supporting portion 214*c* and the shaft portion 214*db* of the first lower supporting portion 214*d* are arranged on the vertical line V1 passing through the center of the axle in a side view.

According to the above configuration, by the elastic deformation of the elastic members 226 and 227, the links 222 and 223 can vertically swing, and the wheelsets can be angularly displaced relative to the cross beam in the steering direction. It should be noted that since the other components are the same as those in Embodiment 1, explanations thereof are omitted.

Embodiment 4

Figure 10:
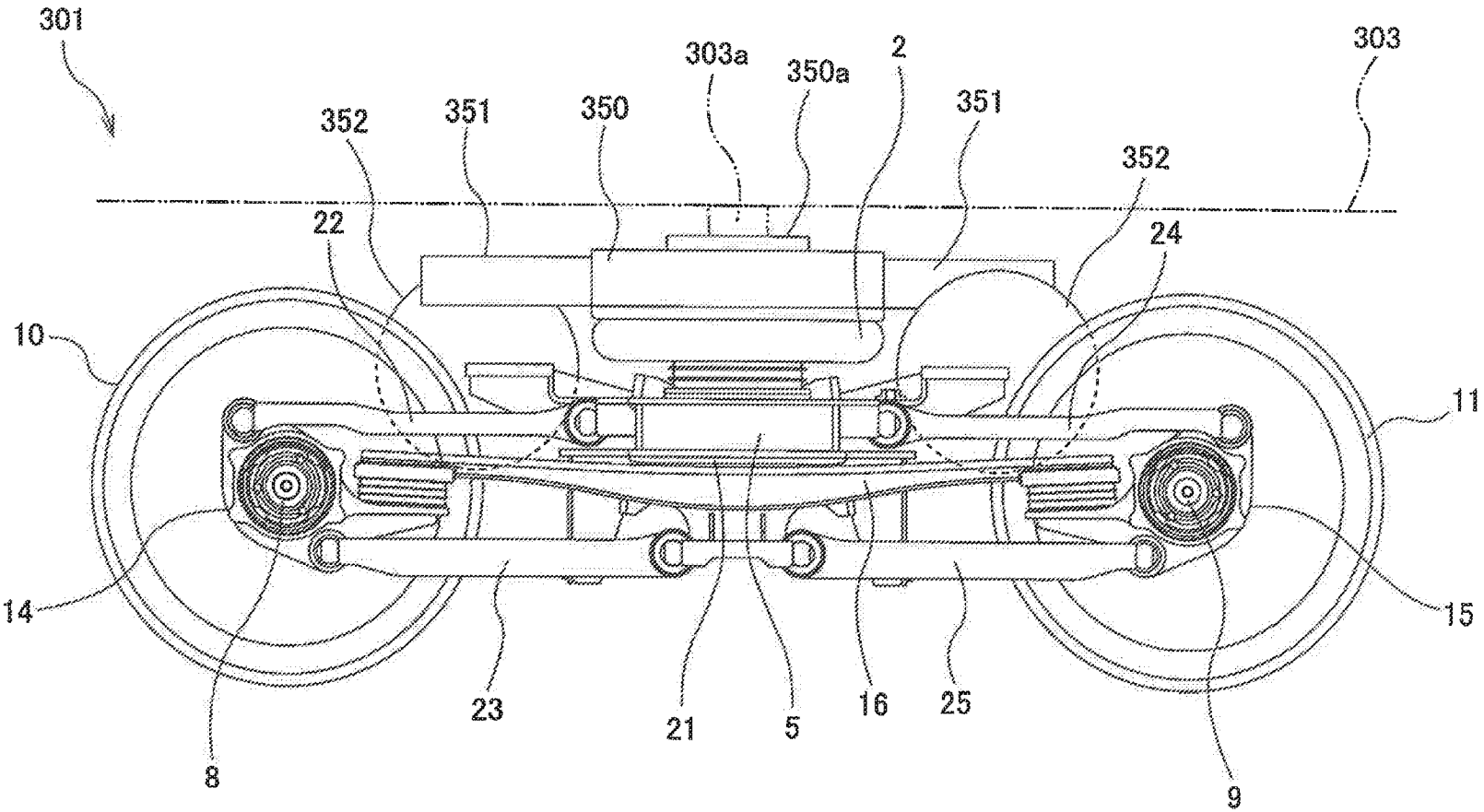
FIG. 10 is a side view showing the bogie for the railcar according to Embodiment 4.

FIG. 10 is a side view showing a bogie 301 for a railcar according to Embodiment 4. As shown in FIG. 10, the bogie 301 of Embodiment 4 is an indirect mounted bogie. To be specific, in the bogie 301, the air spring 2 is provided on the cross beam 5, and a bolster 350 is provided on the air spring 2. The bolster 350 and a carbody 303 are connected to each other by a center plate 350*a* and a pin 303*a* so as to be turnable relative to each other, the pin 303*a* being inserted into the center plate 350*a* from above so as to be rotatable.

Traction motors 352 are coupled to the bolster 350 through respective brackets 351. The traction motors 352 are not coupled to the cross beam 5. The traction motors 352 are coupled to the respective axles 8 and 9 through reducers (not shown). It should be noted that since the other components are the same as those in Embodiment 1, explanations thereof are omitted.

According to the above configuration, since the bolster 350 is arranged on the air spring 2, vibration transferred from the wheels 8 and 9 to the bolster 350 is less than vibration transferred from the wheels 8 and 9 to the cross beam 5. Since the traction motor 352 is coupled to the bolster 350 which vibrates less than the cross beam 5, the strength requirement (0.3G) of the traction motor 352 in this case is made lower than the strength requirement (5G) in a case where the traction motor is coupled to the cross beam 5. Therefore, the traction motor 352 can be reduced in weight and size.

Embodiment 5

Figure 11:
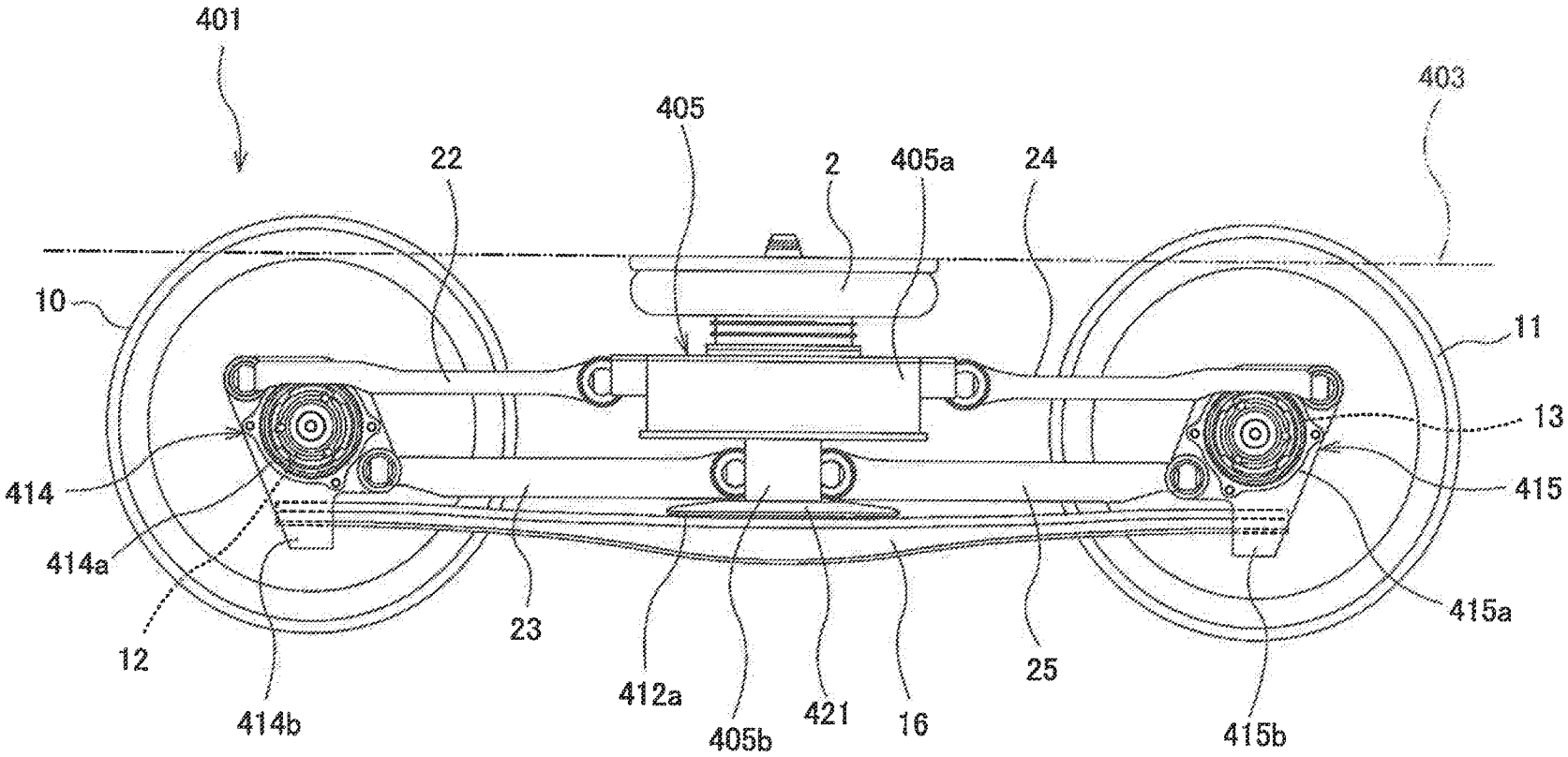
FIG. 11 is a side view showing the bogie for the railcar according to Embodiment 5.

FIG. 11 is a side view showing a bogie for a railcar according to Embodiment 5. As shown in FIG. 11, in a bogie 401 of Embodiment 5, the plate spring 16 is arranged lower than all the links 22 to 25. A cross beam 405 includes: a cross beam main body portion 405*a* extending in the car width direction, the air spring 2 being mounted on the cross beam main body portion 405*a*; and a projecting portion 405*b* projecting downward from the cross beam main body portion 405*a* and shorter than the cross beam main body portion 405*a* in the car longitudinal direction. A pressing member 421 including a pressing surface 21*a* facing downward is provided at a lower end portion of the projecting portion 405*b* of the cross beam 405. The pressing surface 421*a* of the pressing member 421 has a circular-arc shape that is convex downward in a side view.

The plate spring 16 extending in the car longitudinal direction is provided between a first axle box 414 and a second axle box 415. The first axle box 414 includes: a first main body portion 414*a* accommodating the first bearing 12; and a box-shaped first spring supporting portion 414*b* provided at a lower side of the first the main body portion 414*a* and supporting the first end portion of the plate spring 16 from below. The second axle box 415 includes: a second main body portion 415*a* accommodating the second bearing 13; and a box-shaped second spring supporting portion 415*b* provided at a lower side of the second main body portion 415*a* and supporting the second end portion of the plate spring 16 from below. The plate spring 16 is located lower than the first lower link 23 and the second lower link 25 and extends in the car longitudinal direction, and the pressing member 421 is placed on the middle portion of the plate spring 16 from above so as to be displaceable relative to the plate spring 16. The first upper link 22 is arranged so as to overlap a main body portion 414*a* in a side view and is configured in such a shape as not to interfere with the main body portion 414*a*. The second upper link 24 is arranged so as to overlap a main body portion 415*a* in a side view and is configured in such a shape as not to interfere with the main body portion 415*a*. It should be noted that since the other components are the same as those in Embodiment 1, explanations thereof are omitted.

The present invention is not limited to the above embodiments. Modifications, additions, and eliminations of components may be made within the scope of the present invention. The above embodiments may be combined arbitrarily. For example, a part of components or methods in one embodiment may be applied to another embodiment.

INDUSTRIAL APPLICABILITY

As above, the bogie for the railcar according to the present invention has the above excellent effects, and it is useful to widely apply the present invention to bogies of railcars that can achieve the significance of these effects.

REFERENCE SIGNS LIST

1, 101, 301, 401 bogie
2 air spring
5 cross beam
5*g* upper wall portion
5*h* lower wall portion
6 first wheelset

7 second wheelset
8 first axle
9 second axle
10 first wheel
11 second wheel
12 first bearing
13 second bearing
14, 114, 414 first axle box
14*a*, 114*a*, 414*a* first main body portion
14*b*, 114*b*, 414*b* first spring supporting portion
14*c*, 114*c* first upper supporting portion
14*d*, 114*d* first lower supporting portion
15, 115, 415 second axle box
15*a*, 115*a*, 415*a* second main body portion
15*b*, 115*b*, 415*b* second spring supporting portion
15*c*, 115*c* second upper supporting portion
15*d*, 115*d* second lower supporting portion
16 plate spring
21 pressing member
22, 122 first upper link
23, 123 first lower link
24, 124 second upper link
25, 125 second lower link
26, 126 first upper elastic member
27, 127A, 127B first lower elastic member
127Aa, 127Ba upper end portion
127Ab, 127Bb lower end portion
127Ac, 127Bc middle portion
28 second upper elastic member
29 second lower elastic member
34 jack pad
L1 first virtual straight line
L2 second virtual straight line
L3 third virtual straight line
L4 fourth virtual straight line
S plate spring insertion space
V1, V2 vertical line

The invention claimed is:

1. A bogie for a railcar, the bogie comprising:

a first axle box accommodating a first bearing supporting a first axle such that the first axle is rotatable;

a second axle box accommodating a second bearing supporting a second axle such that the second axle is rotatable;

a cross beam extending in a car width direction, a pressing member being provided on a lower side of the cross beam;

a plate spring extending in a car longitudinal direction in a state where a first end portion of the plate spring is supported by the first axle box, and a second end portion of the plate spring is supported by the second axle box, the plate spring supporting the pressing member from below so as to be displaceable relative to the pressing member;

a first upper link extending in the car longitudinal direction to connect the cross beam and the first axle box and including a first end portion elastically coupled to the first axle box;

a first lower link extending in the car longitudinal direction to connect the cross beam and the first axle box and including a first end portion elastically coupled to the first axle box;

a second upper link extending in the car longitudinal direction to connect the cross beam and the second axle box and including a first end portion elastically coupled to the second axle box; and a second lower link extending in the car longitudinal direction to connect the cross beam and the second axle box and including a first end portion elastically coupled to the second axle box, a first upper coupling point where the first end portion of the first upper link and the first axle box are coupled to each other and a first lower coupling point where the first end portion of the first lower link and the first axle box are coupled to each other being arranged on a first virtual straight line passing through a center of the first axle in a side view, a second upper coupling point where the first end portion of the second upper link and the second axle box are coupled to each other and a second lower coupling point where the first end portion of the second lower link and the second axle box are coupled to each other being arranged on a second virtual straight line passing through a center of the second axle in the side view.

2. The bogie according to claim 1, wherein:

a third virtual straight line connecting a coupling point where a second end portion of the first upper link and the cross beam are coupled to each other and a coupling point where a second end portion of the first lower link and the cross beam are coupled to each other is parallel to the first virtual straight line; and a fourth virtual straight line connecting a coupling point where a second end portion of the second upper link and the cross beam are coupled to each other and a coupling point where a second end portion of the second lower link and the cross beam are coupled to each other is parallel to the second virtual straight line.

3. The bogie according to claim 1, further comprising:

a first upper elastic member interposed between the first upper link and the first axle box;

a first lower elastic member interposed between the first lower link and the first axle box;

a second upper elastic member interposed between the second upper link and the second axle box; and a second lower elastic member interposed between the second lower link and the second axle box, wherein:

the first axle box includes a first main body portion accommodating the first bearing, a first upper supporting portion connected to the first upper link through the first upper elastic member, and a first lower supporting portion connected to the first lower link through the first lower elastic member;

the first upper supporting portion and the first lower supporting portion are arranged on the first virtual straight line in the side view;

the second axle box includes a second main body portion accommodating the second bearing, a second upper supporting portion connected to the second upper link through the second upper elastic member, and a second lower supporting portion connected to the second lower link through the second lower elastic member; and the second upper supporting portion and the second lower supporting portion are arranged on the second virtual straight line in the side view.

4. The bogie according to claim 3, wherein:

the first axle box includes a first spring supporting portion projecting from the first main body portion toward a middle side in the car longitudinal direction and supporting the first end portion of the plate spring from below; and the second axle box includes a second spring supporting portion projecting from the second main body portion toward the middle side in the car longitudinal direction and supporting the second end portion of the plate spring from below.

5. The bogie according to claim 1, wherein:

a set of the first upper link and the first lower link constitutes a parallel link; and a set of the second upper link and the second lower link constitutes a parallel link.

6. The bogie according to claim 1, wherein:

an upper surface of the plate spring is a horizontal flat surface in a no-load state; and a longitudinal direction middle portion of the plate spring is thicker in an upward/downward direction than each of both longitudinal direction end portions of the plate spring.

7. The bogie according to claim 1, wherein:

the plate spring is located lower than the first upper link and the second upper link;

the first upper coupling point where the first end portion of the first upper link and the first axle box are coupled to each other and the first lower coupling point where the first end portion of the first lower link and the first axle box are coupled to each other are arranged so as to be displaced from a vertical line passing through the center of the first axle in the side view; and the second upper coupling point where the first end portion of the second upper link and the second axle box are coupled to each other and the second lower coupling point where the first end portion of the second lower link and the second axle box are coupled to each other are arranged so as to be displaced from a vertical line passing through the center of the second axle in the side view.

8. The bogie according to claim 1, further comprising an air spring supported by the cross beam from below, wherein:

first wheels are provided at both respective sides of the first axle;

second wheels are provided at both respective sides of the second axle; and an upper surface of the air spring is located lower than upper ends of the first wheels and upper ends of the second wheels.

9. The bogie according to claim 1, wherein:

each of both end portions of the cross beam includes a side wall portion, an upper wall portion projecting from an upper portion of the side wall portion outward in the car width direction, and a lower wall portion projecting from a lower portion of the side wall portion outward in the car width direction;

the pressing member is provided on a lower side of the upper wall portion; and a plate spring insertion space is formed between the pressing member and the lower wall portion, the plate spring being inserted into the plate spring insertion space, the plate spring insertion space being open outward in the car width direction.

10. The bogie according to claim 9, wherein:

the first upper link and the second upper link are coupled to the upper wall portion; and the first lower link and the second lower link are coupled to the lower wall portion.

11. The bogie according to claim 1, wherein a jack pad is provided on a lower side of the cross beam.

12. The bogie according to claim 11, wherein:

a plate spring insertion space that is open outward in the car width direction is formed on a lower side of the pressing member; and the plate spring is configured to be detachable from the plate spring insertion space outward in the car width direction in a state where the cross beam is lifted in such a manner that the jack pad is pushed upward by a jack device.

13. The bogie according to claim 1, wherein:

at least one of the first upper link and the first lower link is elastically coupled to the first axle box through a rubber bushing; and at least one of the second upper link and the second lower link is elastically coupled to the second axle box through a rubber bushing.

14. The bogie according to claim 3, wherein at least one link among the first upper link, the first lower link, the second upper link, and the second lower link includes an end portion having a C shape in a plan view, the end portion sandwiching at least one supporting portion among the first upper supporting portion, the first lower supporting portion, the second upper supporting portion, and the second lower supporting portion from both sides in the car longitudinal direction.

15. The bogie according to claim 14, wherein among the first upper elastic member, the first lower elastic member, the second upper elastic member, and the second lower elastic member, one elastic member interposed between the at least one link and the at least one supporting portion includes a vertical direction middle portion that is thinner in the car longitudinal direction than each of upper and lower end portions of the one elastic member.

* * * * *